United States Patent [19]

Nakagawa

[11] Patent Number: 4,969,434

[45] Date of Patent: Nov. 13, 1990

[54] OVERHEAD-VALVE TYPE INTERNAL COMBUSTION ENGINE

[75] Inventor: Teruo Nakagawa, Osaka, Japan

[73] Assignee: Kubota Ltd., Osaka, Japan

[21] Appl. No.: 446,887

[22] Filed: Dec. 6, 1989

[30] Foreign Application Priority Data

Dec. 13, 1988 [JP] Japan ..... 63-315853

[51] Int. Cl.[5] ..... F01M 1/00

[52] U.S. Cl. ..... 123/196 M; 123/90.38; 123/90.33

[58] Field of Search ..... 123/196 R, 196 W, 196 M, 123/90.34, 90.38, 572

[56] References Cited

U.S. PATENT DOCUMENTS

| | | | |
|---|---|---|---|
| 4,343,270 | 8/1982 | Kawabe | 123/90.34 |
| 4,563,986 | 1/1986 | Nakano | 123/196 M |
| 4,729,349 | 3/1988 | Sonoda et al. | 123/196 R |
| 4,771,745 | 9/1988 | Nakamura et al. | 123/196 M |
| 4,790,273 | 12/1988 | Oguri et al. | 123/196 W |
| 4,911,120 | 3/1990 | Sumi | 123/196 R |

FOREIGN PATENT DOCUMENTS

| | | |
|---|---|---|
| 60-34512 | 6/1985 | Japan . |
| 63-15530 | 3/1988 | Japan . |

*Primary Examiner*—E. Rollins Cross

*Attorney, Agent, or Firm*—Lowe, Price, LeBlanc, Becker & Shur

[57] ABSTRACT

In an overhead-valve type internal combustion engine, a crank chamber is connected in communication with one side portion of a valve actuating mechanism chamber through a breather passage composed of a passage inlet a passage portion, an outlet chamber and a passage outlet communicated to one another in order. The outlet chamber is formed in the space outside the one side portion of the valve actuating mechanism chamber so as to extend long in the direction of side-by-side arrangement of valve stems. The passage outlet is opened long in the direction of side-by-side arrangement of the valve stems in such a manner as to face the valve stems. A portion, on the side of the passage outlet, of the ceiling surface of the valve actuating mechanism chamber is formed as an inclined surface which increases its height dimension as it gets nearer to the side of rocker arms from the side of the passage outlet.

7 Claims, 3 Drawing Sheets

OVERHEAD-VALVE TYPE INTERNAL COMBUSTION ENGINE

BACKGROUND OF THE INVENTION

1. Field of the Invention

The present invention relates to an overhead-valve type internal combustion engine and more particularly to a lubricating apparatus for lubricating a valve actuating mechanism by inducing oil mist within a crankcase from a breather passage into a valve actuating mechanism chamber together with a flow of blow-by gas carrying the oil mist in the overhead-valve type internal combustion engine.

2. Description of the Prior Art

As such a lubricating apparatus for the valve actuating mechanism, there have been known the ones disclosed in Japanese Laid Open Utility Model Application No. 1985-34512 (referred to as a first conventional embodiment hereinafter) and Japanese Utility Model Publication No. 1988-15530 (referred to as a second conventional embodiment hereinafter).

The lubricating apparatus according to the first conventional embodiment is constructed as follows.

That is, the breather passage for connecting the crankcase and the valve actuating mechanism chamber to each other comprises a passage inlet opened in the crankcase, a passage portion, an outlet chamber and a passage outlet opened in the valve actuating mechanism chamber arranged in order so as to be communicated to one another. The outlet chamber is formed in the space outside one of the opposite side portions of the valve actuating mechanism chamber, in which one side portion valve stems for an intake valve and an exhaust valve are arranged side by side, so as to extend along the direction of side-by-side arrangement of the valve stems. The passage outlet is opened so as to face both the valve stem and rocker arm for the exhaust valve.

Then, the lubricating apparatus according to the second conventional embodiment has following constructions different from the aforementioned first conventional embodiment.

That is, the outlet chamber of the breather passage is formed like a pipe so as to extend straight toward the valve actuating mechanism for the exhaust valve. The passage outlet is provided with two outlets, namely a first passage outlet and a second passage outlet. The first passage outlet is opened at the leading end of the pipe-like outlet chamber so as to face the contact portion between the valve stem and the rocker arm for the exhaust valve. The second passage outlet is opened in the longitudinal midway portion of the pipe-like outlet chamber so as to face the contact portion between the valve stem and the rocker arm for the intake valve.

But, there are following disadvantages associated with the aforementioned respective conventional embodiments.

In the lubricating apparatus for the valve actuating mechanism according to the first conventional embodiment, since the lubricating oil can not be supplied sufficiently to both the pivot portion of the rocker arm, the contact portion between the rocker arm and the push rod and the like located remote from the passage outlet and required to be lubricated in spite that the lubricating oil can be supplied sufficiently to the respective valve stems for the intake valve and the exhaust valve and the contact portions between the valve stems and the rocker arms, it is apprehended that those pivot portions and contact portions become short of the lubricating oil.

In the second conventional embodiment, since the supply quantity of the lubricating oil from the second passage outlet to the intake valve side is limited to a needed minimum quantity while the exhaust valve side is lubricated intensively by the lubricating oil delivered from the first passage outlet, advantageously the lubricating oil can be prevented from flowing along the valve stem of the intake valve and entering a combustion chamber. There are, however, such an unsolved problem that the portions located remote from both the passage outlets and required to be lubricated become short of the lubricating oil also in this second conventional embodiment similarly to the first conventional embodiment.

SUMMARY OF THE INVENTION

It is an object of the present invention to enable to sufficiently lubricate portions required to be lubricated such as pivot portions of rocker arms and the like located remote from an outlet of a breather passage while carrying out a positive lubrication for valve stems of an intake valve and an exhaust valve and contact portions between the valve stems and the rocker arms.

For accomplishing the above-mentioned object, the present invention has the following structural feature.

That is, an valve actuating mechanism chamber formed between a cylinder head and a head cover is provided with a first side portion for accommodating valve stems and a second side portion for accommodating rocker arms. A breather passage comprises a passage inlet, a passage portion, an outlet chamber and a passage outlet communicated to one another in order. The passage inlet is communicated to a crankcase, and the passage outlet is communicated to the valve actuating mechanism chamber.

The outlet chamber is formed in the space outside the first side portion of the valve actuating mechanism chamber so as to extend in the direction of side-by-side arrangement of the valve stems.

The passage outlet is opened long between the first side portion of the valve actuating mechanism chamber and the outlet chamber so as to extend in the direction of side-by-side arrangement of the valve stems and at least to face the valve stems and the interval between the valve stems continuously.

Further, a portion of a ceiling surface of the valve actuating mechanism chamber at the first side portion is formed as such an inclined surface as to become higher as it gets nearer to the rocker arms side from the passage outlet side.

Since the present invention is constructed as mentioned above, the following advantages can be provided.

A portion of scattered lubricating oil within the crankcase is adapted to be introduced into the outlet chamber from the passage portion of the breather passage with being carried by a flow of blow-by gas. The lubricating oil brought into the outlet chamber flows slowly into the first side portion of the valve actuating mechanism chamber from the passage outlet with forming in the shape of a belt while flowing in the longitudinal direction within the outlet chamber so as to positively lubricate the respective valve stems of the intake valve and the exhaust valve and the contact portions between the valve stems and the rocker arms and further flows into the second side portion of the valve actuating mechanism chamber along the ceiling surface of the valve actuating mechanism chamber so as to sufficiently lubricate the pivot portions of the rocker arms, the contact portions between the respective rocker arms and respective push rods and the like located remote from the passage outlet.

Therefore, the portions required to be lubricated within the valve actuating mechanism chamber can be positively supplied with the lubricating oil so that seize and unequal wear can be prevented.

The foregoing and other objects and attendant advantages of the present invention will be readily appreciated as the same becomes better understood by reference to the following detailed description when considered by the accompanying drawings, wherein:

BRIEF DESCRIPTION OF THE DRAWINGS

FIG. 1 is a vertical sectional front view of an overhead-valve type internal combustion engine;

FIG. 2 is an enlarged view of a principal portion in FIG. 1;

FIG. 3 is a view taken along the III—III directed line in FIG. 1 and showing the state in which a valve actuating mechanism has been removed from a cylinder head;

FIG. 4 is a sectional view taken along the IV—IV directed line in FIG. 3; and FIG. 5 is a schematic perspective view of a principal portion of the cylinder head.

DESCRIPTION OF THE PREFERRED EMBODIMENT

Figure 1:
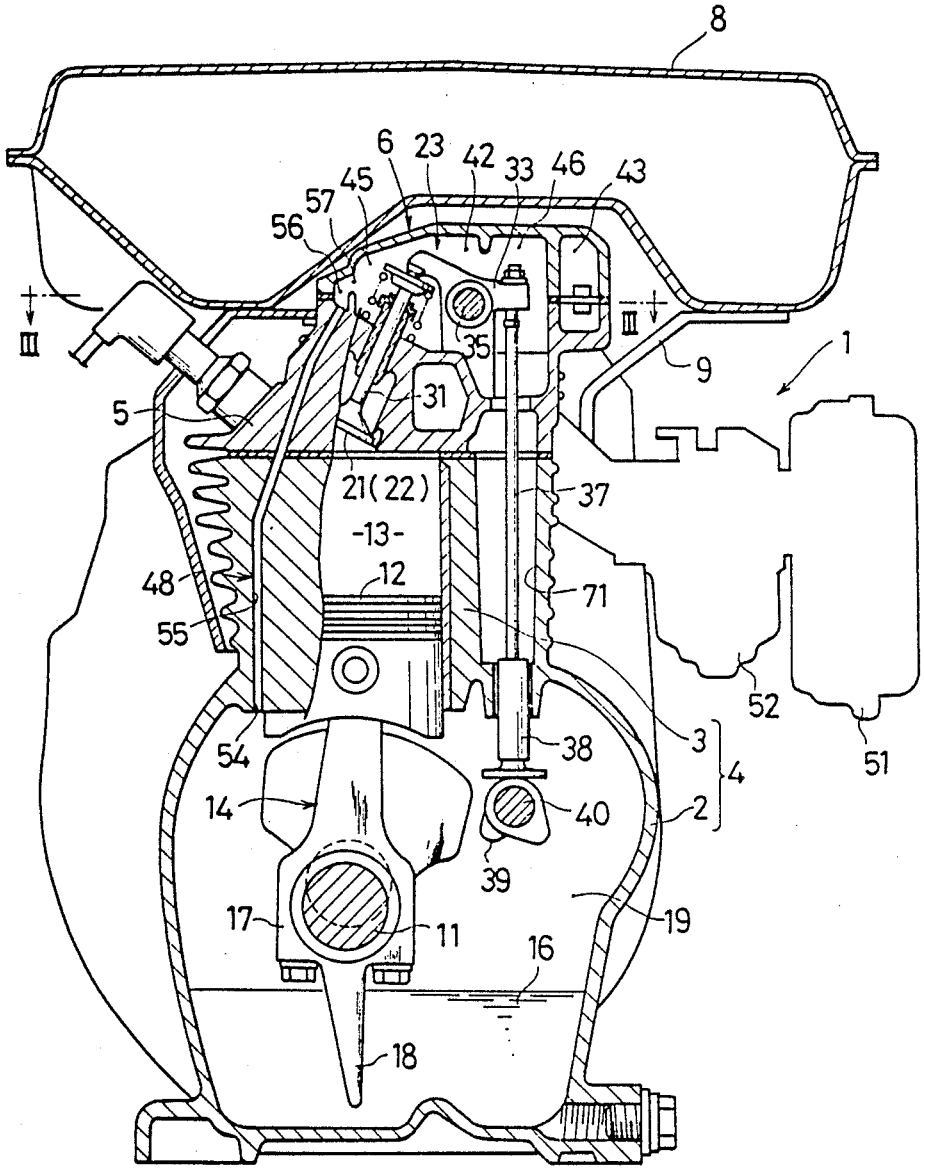
FIGS. 1 through 5 show one embodiment of the present invention.

First of all, a general structure of an overhead-valve type engine 1 will be explained with reference to FIGS. 1 through 3.

This engine 1 is a vertical forced air-cooled gasoline engine and is provided with a cylinder block 4 having a cylinder barrel 3 integrated with a crankcase 2 at the upper portion thereof 2. A cylinder head 5 and a head cover 6 are mounted on the cylinder barrel 3 in order from below. A fuel tank 8 is fixedly secured to the cylinder block 4 above the upside of the head cover 6 through a bracket 9.

A crank shaft 11 is supported rotatably by the crankcase 2 so as to extend in the fore and back direction (in the direction perpendicular to the paper surface in FIG. 1) at the midway height portion thereof 2. A piston 12 is accommodated within the cylinder barrel 3 vertically slidably and airtightly, and a combustion chamber 13 is formed above the piston 12. The piston 12 and the crank shaft 11 are connected interlockingly through a connecting rod 14. A lubricating oil 16 stored within the lower portion of the crankcase 2 is adapted to be splashed up by means of an oil-dipper 18 projected downward from a big end 17 of the connecting rod 14 so as to be scattered around within a crank chamber 19. Portions required to be lubricated such as bearing portions within the crank chamber 19, the inner wall portion of the cylinder barrel 3 and the like are lubricated by the scattered oil.

The cylinder head 5 is equipped with an intake valve 21, an exhaust valve 22 and a valve actuating mechanism 23.

That is, a valve guide 27 for the intake valve 21 and a valve guide 28 for the exhaust valve 22 are fixedly secured to the left backside portion (the upper portion in FIG. 3) of the cylinder head 5 and to the left foreside portion (the lower portion in FIG. 3) thereof 5 respectively in such a manner as to pass through each portion in the left downward direction. A valve stem 31 of the intake valve 21 and a valve stem (not illustrated) of the exhaust valve 22 are supported slidably by means of guide holes 29, 30 of the respective valve guides 27, 28.

A rocker arm 33 for the intake valve 21 and a rocker arm (not illustrated) for the exhaust valve 22 are supported vertically swingably by means of a pivot portion 35 comprising a pivot shaft located on the right portion of the cylinder head 5. One end portion of the rocker arm 33 for the intake valve 21 is kept in contact with a stem end **31*a* of the valve stem 31 for the intake valve 21, and the other end portion of the rocker arm 33 is connected interlockingly to a valve actuating cam shaft 40 through a push rod 37, a valve lifter 38 and a valve actuating cam 39 in order. Also the rocker arm for the exhaust valve 22 is adapted to be actuated similarly to the rocker arm 33 for the intake valve 21. The valve actuating cam shaft 40 is connected interlockingly to the crank shaft 11** through a timing adjusting gear assembly (not illustrated).

Between the cylinder head 5 and the head cover 6 there are provided a valve actuating mechanism chamber 42 and a breather chamber 43 formed on the left side and on the right side respectively.

The valve actuating mechanism chamber 42 comprises a first side portion 45 (the left portion in FIGS. 1 through 3) for accommodating both the valve stem 31 of the intake valve 21 and the valve stem of the exhaust valve 22 and a second side portion 46 (the right portion therein) for accommodating both the rocker arm 33 for the intake valve 21 and the rocker arm for the exhaust valve 22. The first side portion 45 of the valve actuating mechanism chamber 42 is communicated with the crank chamber 19 through the breather passage 48, and the second side portion 46 of the valve actuating mechanism chamber 42 is communicated with a breather chamber 43 through a communication hole 49 (referred to FIG. 3). The breather chamber 43 is communicated to a portion between the an air cleaner 51 and a carburetor 52 through a reed valve 50 and a breather tube (not illustrated) in order. The breather passage 48 comprises a passage inlet 54 opened in the crank chamber 19, a passage portion 55 formed in the cylinder block 4 and the cylinder head 5 so as to pass therethrough, an outlet chamber 56 formed in the left outside of the first side portion 45 of the valve actuating mechanism chamber 42 and a passage outlet 57 opened in the valve actuating mechanism chamber 42 communicated to one another in order from below.

Figure 4:
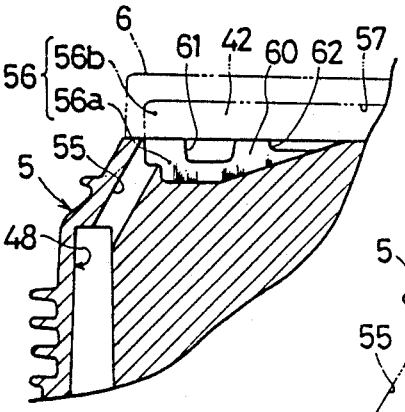
Figure 5:
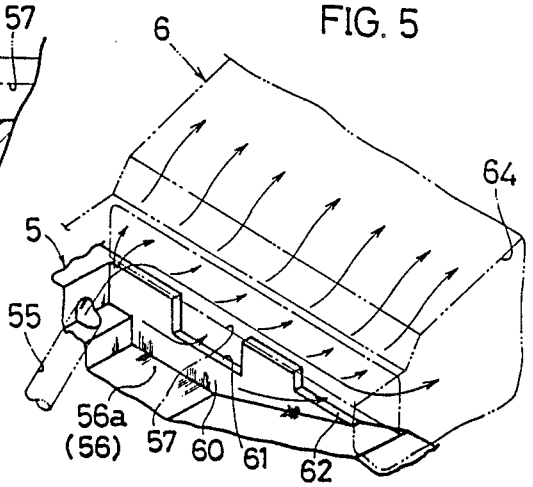

Then, the outlet chamber 56 and the passage outlet 57 of the breather passage 48 will be explained in greater detail mainly with reference to FIGS. 4 and 5.

The outlet chamber 56 comprises a first outlet chamber portion **56*a* formed in the cylinder head 5 and a second outlet chamber portion 56*b* formed in the head cover 6, communicated vertically and directly to each other. Both the outlet chamber portions 56*a*, 56*b* are formed long so as to extend in the direction (the fore and back direction) of side-by-side arrangement of the valve stem 31 of the intake valve 21 and the valve stem of the exhaust valve 22. The upper end portion of the passage portion 55 is opened in the end portion (the backside end portion), on the side of the intake valve 21, of the longitudinal opposite end portions of the first outlet chamber portion 56*a* so as to face slantly upward toward the central portion of the valve actuating mechanism chamber 42**.

The passage outlet 57 is opened long in the fore and back direction between the first side portion 45 of the valve actuating mechanism chamber 42 and the second outlet chamber portion **56*b* so as to face at least both the valve stem 31 of the intake valve 21 and the valve stem of the exhaust valve 22** and the interval between both the valve stems continuously.

In a belt-shaped wall 60 between the first side portion 45 of the valve actuating mechanism chamber 42 and the first outlet chamber portion **56*a* of the outlet chamber 56 there are provided a first auxiliary outlet 61 opened so as to face the valve stem 31 of the intake valve 21 and a second auxiliary outlet 62 opened so as to face the valve stem of the exhaust valve 22. The opening area of the first auxiliary outlet 61 is larger than that of the second auxiliary outlet 62**.

Figure 2:
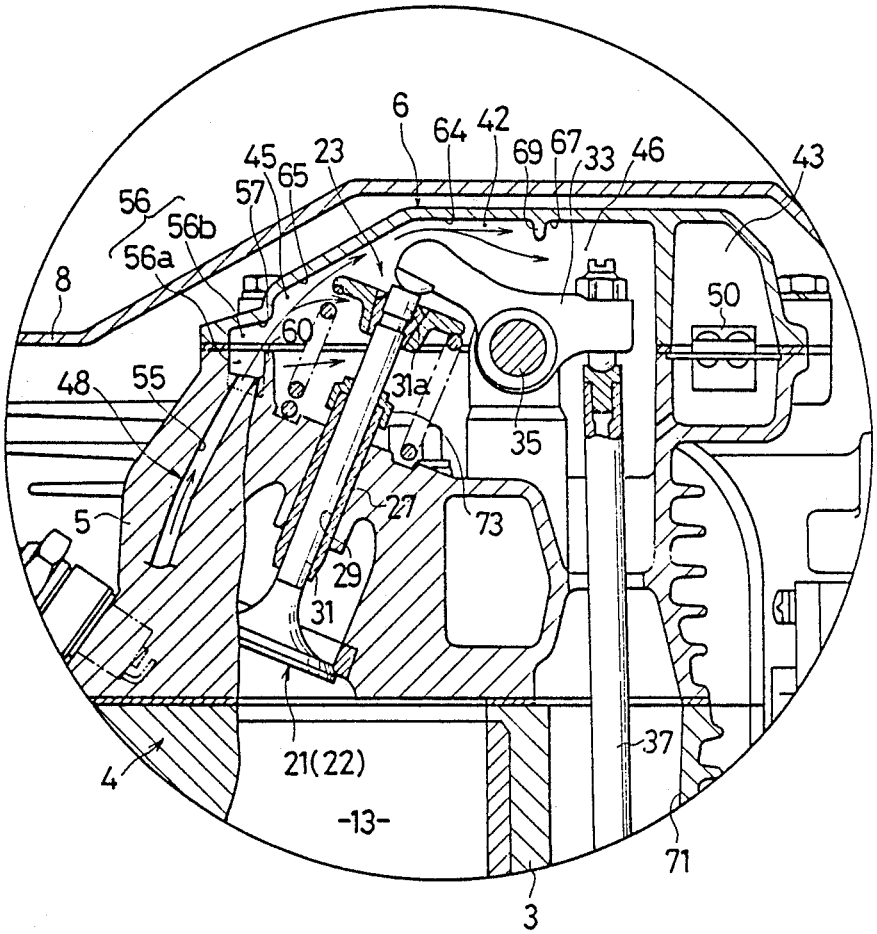
Figure 3:
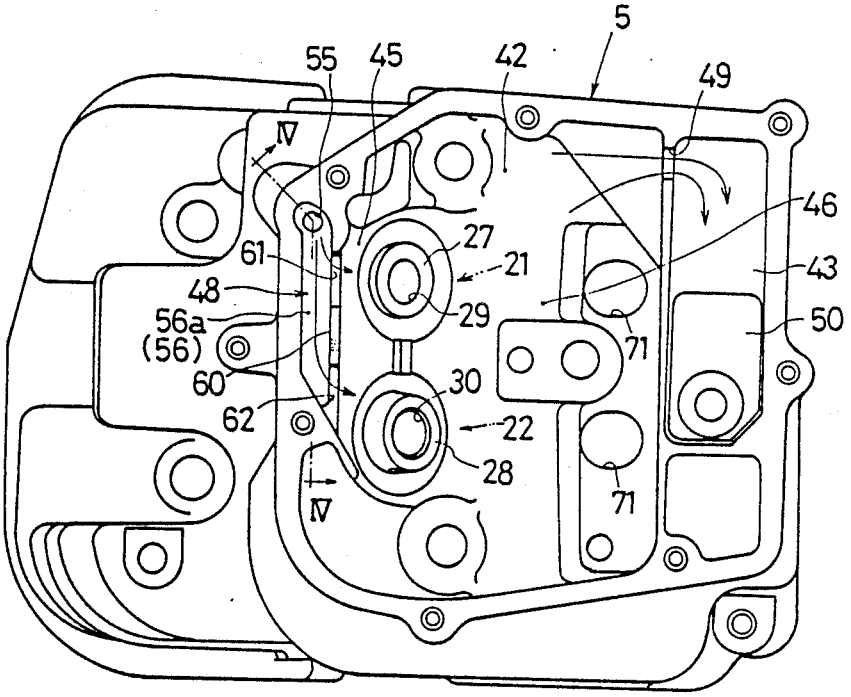

Further, as shown in FIG. 2, a left side portion 65 (on the side of the first side portion 45) of a ceiling surface 64 of the valve actuating mechanism chamber 42, formed by the upper wall of the head cover 6 is inclined right upward. That is, the portion 65 of the ceiling surface 64 is formed so as to increase its height dimension as it gets nearer to the side of the right rocker arm 33 from the side of the left passage outlet 57. A portion 67 of the ceiling surface 64 above the rocker arm pivot portion 35 is provided with a baffle portion 69 projected downward toward the pivot portion 35 therefrom 67. Though it is preferable to form the baffle portion 69 in such a manner as to extend continuously along the extending direction of the rocker arm pivot portion 35, namely in the fore and back direction, it may be formed intermittently with intervals provided in the fore and back direction.

According to the aforementioned construction, when the engine 1 is operated, a portion of the lubricating oil splashed up and scattered around by means of the dipper 18 within the crank chamber 19 is introduced into the valve actuating mechanism chamber 42 through the breather passage 48 with being carried by a flow of blow-by gas blown into the crank chamber 19 from the combustion chamber 13 through a sliding gap between the cylinder barrel 3 and the piston 12 so as to carry out the lubrication for the intake valve 21, the exhaust valve 22 and the valve actuating mechanism 23 there. After that, further a portion thereof is adapted to be returned to the crank chamber 19 through push rod holes 71. By the way, the blow-by gas is adapted to be returned to an inlet side of the carburetor 52 from the breather chamber 43 through the reed valve 50.

The lubricating oil introduced into the backside of the outlet chamber 56 from the passage portion 55 of the breather passage 48 as mentioned above, while flowing forward within the outlet chamber 56, flows slowly into the first side portion 45 of the valve actuating mechanism chamber 42 from the passage outlet 57 and both the auxiliary outlet 61, 62 so as to lubricate the contact portions between the respective valve stems of the intake and exhaust valves 21, 22 and the respective rocker arms and also the sliding surfaces of the respective valve guides 27, 28 and the respective associated valve stems.

Then, the lubricating oil delivered from the passage outlet 57 flows into the second side portion 46 of the valve actuating mechanism chamber 42 along the ceiling surface 64 of the valve actuating mechanism chamber 42 with spreading in the shape of a wide belt so as to sufficiently lubricate the rocker arm pivot portion 35 and the contact portions between the respective rocker arms and the respective push rods. A portion of the lubricating oil delivered along the ceiling surface 64 comes into collision with the baffle portion 69 so as to adhere to its surface and to drop onto the rocker arm pivot portion 35. Further, the lubricating oil delivered from both the auxiliary outlets 61, 62 lubricates the intake valve 21 and the exhaust valve 22 intensively.

Accordingly, the portion required to be lubricated within the valve actuating mechanism chamber 42 can be positively supplied with the lubricating oil so that seize and unequal wear can be prevented.

Further, at one end portion, on the side of the valve actuating mechanism chamber 42, of the upper and lower opposite end portions of the guide hole 29 of the valve guide 27 for the intake valve 21 of both the valves 21, 22 there is provided a sealing means 73 comprising a stem seal. The sealing means 73 covers the slide gap between the guide hole 29 and the valve stem 31 so as to restrain the lubricating oil from being supplied excessively to the slide gap. Thereby, the lubricating oil can be prevented from entering the combustion chamber 13 coming down along the valve stem 31, and the carbonized lubricating oil can be prevented from being deposited on the wall surface of the combustion chamber 13.

Incidentally, though the aforementioned embodiment employs the overhead-valve type engine which is adapted to drive the rocker arms 33 by means of the push rods 37, the present invention may be applied to an overhead-valve type engine which employs an overhead cam shaft. The engine according to the present invention may be of a horizontal type or of a vertical shaft type besides of the vertical type described in the embodiment.

Further, the outlet chamber of the breather passage 48 may be formed in either of the cylinder head 5 or the head cover 6 instead of the outlet chamber 56 comprising the outlet chamber portions **56*a*, 56*b* formed in the cylinder head 5 and in the head cover 6 respectively. In this case, the passage outlet of the breather passage 48 should be formed in only either of both above-mentioned ones 5, 6 and the auxiliary outlets 61, 62 employed in the embodiment can be omitted. The outlet chamber may be formed in a separate member from the cylinder head 5 and the head cover 6. Further, the passage portion of the breather passage 48 may be opened in the outlet chamber 56 at the central position or at the position on the side of the exhaust valve 22 in the longitudinal direction of the outlet chamber 56 instead of at the position on the side of the intake valve 21**.

What is claimed is:

1. An overhead-valve type internal combustion engine comprising in combination:

a cylinder block provided with a crank chamber;

a cylinder head fixedly secured to the cylinder block and provided with a valve stem of an intake valve, a valve stem of an exhaust valve and rocker arms;

a head cover fixedly secured to the cylinder head;

a valve actuating mechanism chamber formed between the cylinder head and the head cover and composed of a first side portion for accommodating the valve stems and a second side portion for accommodating the rocker arms;

a breather passage composed of a passage inlet, a passage portion, an outlet chamber and a passage outlet communicated to one another in order;

said passage inlet being in communication with the crank chamber;

said passage outlet being in communication with the valve actuating mechanism chamber;

said outlet chamber being formed in the space outside the first side portion of the valve actuating mechanism chamber so as to extend long in the direction of side-by-side arrangement of the valve stems;

said passage outlet being opened long in the direction of side-by-side arrangement of the valve stems between the first side portion of the valve actuating mechanism chamber and the outlet chamber so as to face at least the valve stems and the interval between the valve stems continuously; and said valve actuating mechanism chamber provided with a ceiling surface a portion of which above the first side portion being formed as an inclined surface increasing its height dimension as it gets nearer to the side of the rocker arms from the side of the passage outlet.

2. An overhead-valve type internal combustion engine as defined in claim 1, wherein:

said passage portion of the breather passage is opened in the outlet chamber at one end position, on the side of the intake valve, of the opposite ends of the outlet chamber in its longitudinal direction.

3. An overhead-valve type internal combustion engine as defined in claim 2, wherein:

said outlet chamber of the breather passage is composed of a first outlet chamber portion formed in the cylinder head and a second outlet chamber portion formed in the head cover communicated to each other directly, and said passage outlet is opened in the second outlet chamber portion.

4. An overhead-valve type internal combustion engine as defined in claim 3, wherein:

between the first side portion of the valve actuating mechanism chamber and the first outlet chamber portion of the outlet chamber, a first auxiliary outlet is opened so as to face the valve stem of the intake valve and a second auxiliary outlet is opened so as to face the valve stem of the exhaust valve.

5. An overhead-valve type internal combustion engine as defined in claim 4, wherein:

said first auxiliary outlet is formed larger in opening area than the second auxiliary outlet.

6. An overhead-valve type internal combustion engine as defined in claim 5, wherein:

a sealing means for restraining an excessive lubricating oil supply to the intake valve is mounted on a guide hole for the intake valve provided in the cylinder head, at its one end, on the side of the valve actuating mechanism chamber, of the opposite ends of the guide hole, and a slide gap between the guide hole for the intake valve and the valve stem of the intake valve is covered by means of the sealing means.

7. An overhead-valve type internal combustion engine as defined in claim 1, wherein:

a baffle portion is formed in a portion, above a rocker arm pivot portion, of the ceiling surface of the valve actuating mechanism chamber in such a manner as to be projected toward the rocker arm pivot portion.

* * * * *